US010362388B2

(12) United States Patent
Jeffery

(10) Patent No.: US 10,362,388 B2
(45) **Date of Patent: *Jul. 23, 2019**

(54) PASSIVE RADIATORS AND RELATED DEVICES

(71) Applicant: Bose Corporation, Framingham, MA (US)

(72) Inventor: Nathan A. Jeffery, Boston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/132,782

(22) Filed: Sep. 17, 2018

(65) Prior Publication Data

US 2019/0020945 A1 Jan. 17, 2019

Related U.S. Application Data

(62) Division of application No. 15/335,933, filed on Oct. 27, 2016, now Pat. No. 10,097,916.

(51) Int. Cl.

| | |
|---|---|
| ***H04R 1/46*** | (2006.01) |
| ***H04R 1/28*** | (2006.01) |
| ***H04R 1/02*** | (2006.01) |
| ***H04R 7/18*** | (2006.01) |
| ***H04R 7/12*** | (2006.01) |
| ***H04R 9/06*** | (2006.01) |
| ***H04R 9/02*** | (2006.01) |
| *H04R 7/04* | (2006.01) |
| *H04R 31/00* | (2006.01) |

(52) U.S. Cl.

CPC ..... *H04R 1/2834* (2013.01); *H04R 1/025* (2013.01); *H04R 7/127* (2013.01); *H04R 7/18* (2013.01); *H04R 9/025* (2013.01); *H04R 9/06* (2013.01); *H04R 7/04* (2013.01); *H04R 31/003* (2013.01); *H04R 2307/025* (2013.01)

(58) Field of Classification Search

CPC combination set(s) only.
See application file for complete search history.

(56) References Cited

U.S. PATENT DOCUMENTS 5,416,283 A * 5/1995 Dault ..... B60R 11/0217 181/141
2004/0213429 A1* 10/2004 Seidler ..... H04R 1/025 381/386

* cited by examiner

*Primary Examiner* — Amir H Etesam

(57) ABSTRACT

A passive radiator includes an elastomeric member and mass. The elastomeric member defines a suspension structure that has an inner peripheral boarder and an outer peripheral boarder and a first snap-attach feature that is arranged along the outer peripheral boarder of the suspension structure. The first snap-attach feature enables the elastomeric member to be coupled to a mating feature. The mass is supported along the inner peripheral boarder of the suspension structure and is configured for pistonic movement, relative to the first snap-attach feature, along a motion axis of the passive radiator.

16 Claims, 4 Drawing Sheets

PASSIVE RADIATORS AND RELATED DEVICES

CROSS-REFERENCE TO RELATED APPLICATIONS

This application is a divisional of U.S. application Ser. No. 15/335,933, filed Oct. 27, 2016, now pending, the contents of which are incorporated herein by reference.

BACKGROUND

This disclosure relates to passive radiators and related devices (e.g., loudspeakers).

Passive radiators (sometimes referred to as "drones" or "drone cones") are acoustic elements that can be used to increase the low frequency output of a loudspeaker, thereby giving the loudspeaker comparable performance characteristics to those of a larger system. A passive radiator typically has the appearance of a standard cone type electro-acoustic transducer, but with the electric motor (coil and magnet) removed; and generally includes a diaphragm, and a suspension (a/k/a "surround"), and, in some cases, a mounting frame.

In typical use, a passive radiator is mounted to an acoustic enclosure (a sealed speaker box) along with an electro-acoustic transducer (a/k/a/"speaker" or "driver") that converts electrical signals to acoustic energy. The sound pressure resulting from the acoustic energy provided by the electro-acoustic transducer drives the motion of the passive radiator. The movement of the passive radiator creates sound waves just as a normal transducer does.

Often, a passive radiator is tuned to change the way its compliance interacts with the motion of air in the acoustic enclosure by adding a mass to its diaphragm. In some cases, the mass (e.g., a metal block) is secured to the diaphragm with an adhesive.

In some alternative configurations the surround is molded directly around the mass in an insert molding process, or a multi-shot injection molding process. Such assembly processes effectively render the mass inseparable, and, thus, may not be ideal where tuning adjustments are desirable.

SUMMARY

All examples and features mentioned below can be combined in any technically possible way.

In one aspect, a passive radiator includes an elastomeric member and mass. The elastomeric member defines a suspension structure that has an inner peripheral boarder and an outer peripheral boarder and a first snap-attach feature that is arranged along the outer peripheral boarder of the suspension structure. The first snap-attach feature enables the elastomeric member to be coupled to a mating feature. The mass is supported along the inner peripheral boarder of the suspension structure and is configured for pistonic movement, relative to the first snap-attach feature, along a motion axis of the passive radiator.

Implementations may include one of the following features, or any combination thereof.

In some implementations, the first snap-attach feature includes a recess for receiving a rib of the mating feature, and the recess defines a groove for receiving a detent on the rib.

In certain implementations, the groove faces inward toward the motion axis of the passive radiator.

In some examples, the first snap-attach feature includes a recess that extends continuously in a closed form about a periphery of the suspension structure for receiving a peripheral rib of the mating feature, and the recess defines a groove for receiving a detent on the peripheral rib.

In certain examples, the groove extends along an inner peripheral edge of the recess.

In some cases, the suspension structure is in the form of a half-roll surround.

In certain cases, the elastomeric member further defines a second snap-attach feature for coupling the mass to the elastomeric member.

In some implementations, the elastomeric member further defines a diaphragm and the second snap-attach feature includes a sidewall that extends outwardly from the diaphragm and forms a pocket therewith for receiving the mass. The sidewall includes a protrusion for engaging an area along the peripheral edge of the mass thereby to retain the mass in the pocket.

In another aspect, a passive radiator includes a mass and an elastomeric member. The elastomeric member defines a suspension structure having an inner peripheral boarder and an outer peripheral boarder; and a first snap-attach feature along the inner peripheral boarder of the suspension structure for coupling the elastomeric member to the mass.

Implementations may include one of the above and/or below features, or any combination thereof.

In some implementations, the elastomeric member further defines a diaphragm and the first snap-attach feature includes a sidewall that extends outwardly from the diaphragm and forms a pocket therewith for receiving the mass. The sidewall includes a protrusion for engaging an area along the peripheral edge of the mass thereby to retain the mass in the pocket.

In certain implementations, the protrusion extends inward toward a motion axis of the passive radiator.

In some cases, the elastomeric member further defines a through hole that extends through the diaphragm to allow air trapped between the mass and the diaphragm to be released as the mass is inserted into the pocket.

In certain cases, the elastomeric member further defines a second snap-attach feature arranged along the outer peripheral boarder of the suspension structure for coupling the elastomeric member to a mating feature. The second snap-attach feature includes a recess that extends continuously in a closed form about a periphery of the suspension structure for receiving a rib of the mating feature, and the recess defines a groove for receiving a detent on the peripheral rib.

Another aspect provides a loudspeaker that includes an acoustic enclosure defining an acoustic cavity, a passive radiator that is coupled to the acoustic enclosure, and an electro-acoustic transducer that is mounted to the acoustic enclosure such that sound waves generated by the electro-acoustic transducer are capable of acoustically energizing the passive radiator. The passive radiator includes an elastomeric member and a mass. The elastomeric member defines a suspension structure having an inner peripheral boarder and an outer peripheral boarder, and a first snap-attach feature that is arranged along the outer peripheral boarder of the suspension structure for coupling the elastomeric member to a mating element on the acoustic enclosure. The mass is supported along the inner peripheral boarder of the suspension structure and is configured for pistonic movement, relative to the first snap-attach feature, along a motion axis.

Implementations may include one of the above and/or below features, or any combination thereof.

In some implementations, the first snap-attach feature is configured to couple with a mating feature on the acoustic enclosure and includes a recess for receiving a rib on the acoustic enclosure. The recess defines a groove for receiving a detent on the rib.

In certain implementations, the recess extends continuously in a closed form about the outer peripheral boarder of the suspension structure.

In some cases, the recess is undersized relative to the rib so as to form a compression fit with the rib.

In certain cases, the groove extends continuously in a closed form along an inner peripheral edge of the recess In some examples, the elastomeric member further defines a second snap-attach feature for coupling the mass to the elastomeric member.

In some implementations, the elastomeric member further defines a diaphragm and the second snap-attach feature includes a sidewall that extends outwardly from the diaphragm and forms a pocket therewith for receiving the mass. The sidewall includes a protrusion for engaging an area along the peripheral edge of the mass thereby to retain the mass in the pocket.

In certain implementations, the pocket is arranged to face into the acoustic enclosure when mounted thereto.

Another aspect features a loudspeaker that includes an acoustic enclosure defining an acoustic cavity, a passive radiator coupled to the acoustic enclosure, and an electro-acoustic transducer mounted to the acoustic enclosure such that sound waves generated by the electro-acoustic transducer are capable of acoustically energizing the passive radiator. The passive radiator includes a mass and an elastomeric member. The elastomeric member defines a suspension structure having an inner peripheral boarder and an outer peripheral boarder, and a first snap-attach feature along the inner peripheral boarder of the suspension structure for coupling the elastomeric member to the mass.

Implementations may include one of the above and/or below features, or any combination thereof.

In some implementations, the elastomeric member further defines a diaphragm and the first snap-attach feature includes a sidewall that extends outwardly from the diaphragm and forms a pocket therewith for receiving the mass. The sidewall includes a protrusion for engaging an area along the peripheral edge of the mass thereby to retain the mass in the pocket.

In certain implementations, the pocket is arranged to face into the acoustic enclosure when mounted thereto.

Implementations may provide one or more of the following benefits.

In some implementations, because a passive radiator is made from a single part of elastomeric material it can be made using processes like compression molding which are considerably less costly and time consuming than multi-shot injection molding.

In certain implementations, the use of snap-attach features reduces (e.g., eliminates) the additional part cost and processing time for attachment methods likes screws or adhesives.

DETAILED DESCRIPTION

This disclosure is based on the realization that the conventional methods for attaching a passive radiator to an acoustic enclosure and/or for attaching a mass to a diaphragm of the passive radiator can be improved upon by utilizing a snap-attach feature. The use of snap-attach features can reduce assembly time, e.g., by reducing the need for installing individual hardware fasteners, and can allow for simplified repair or replacement of component parts by reducing the reliance on adhesives and thereby allowing easier separation and swapping out of individual components.

Figure 1A:
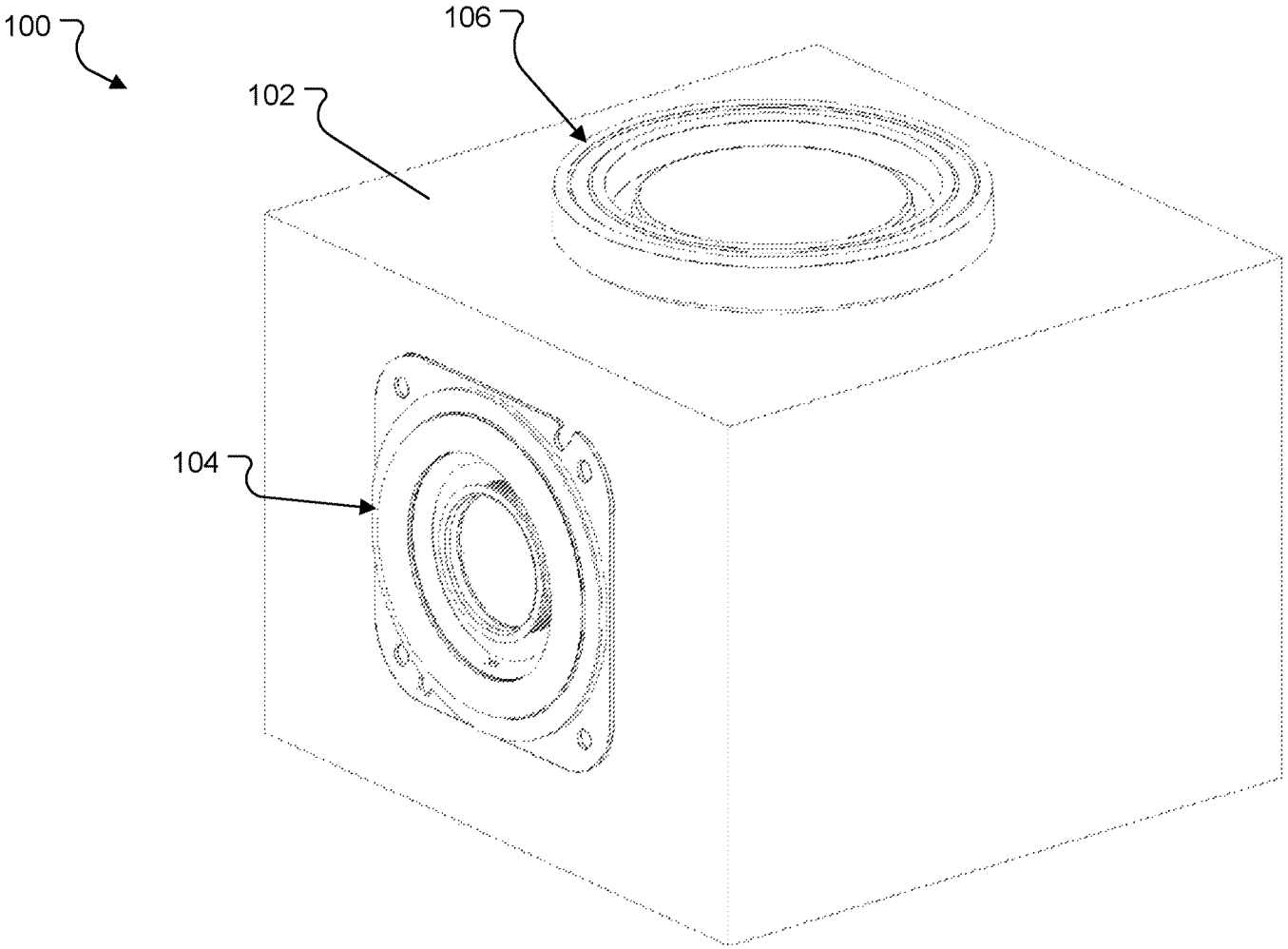
FIG. 1A is a perspective view of a loudspeaker.

FIG. 1A illustrates an exemplary loudspeaker 100 which includes an acoustic enclosure 102, an electro-acoustic transducer 104, and a passive radiator 106. Notably, the passive radiator 106 is provided with snap-attach features for attaching the passive radiator 106 to the acoustic enclosure 102 and for coupling a mass to a diaphragm of the passive radiator 106, as will be discussed in greater detail below.

Figure 1B:
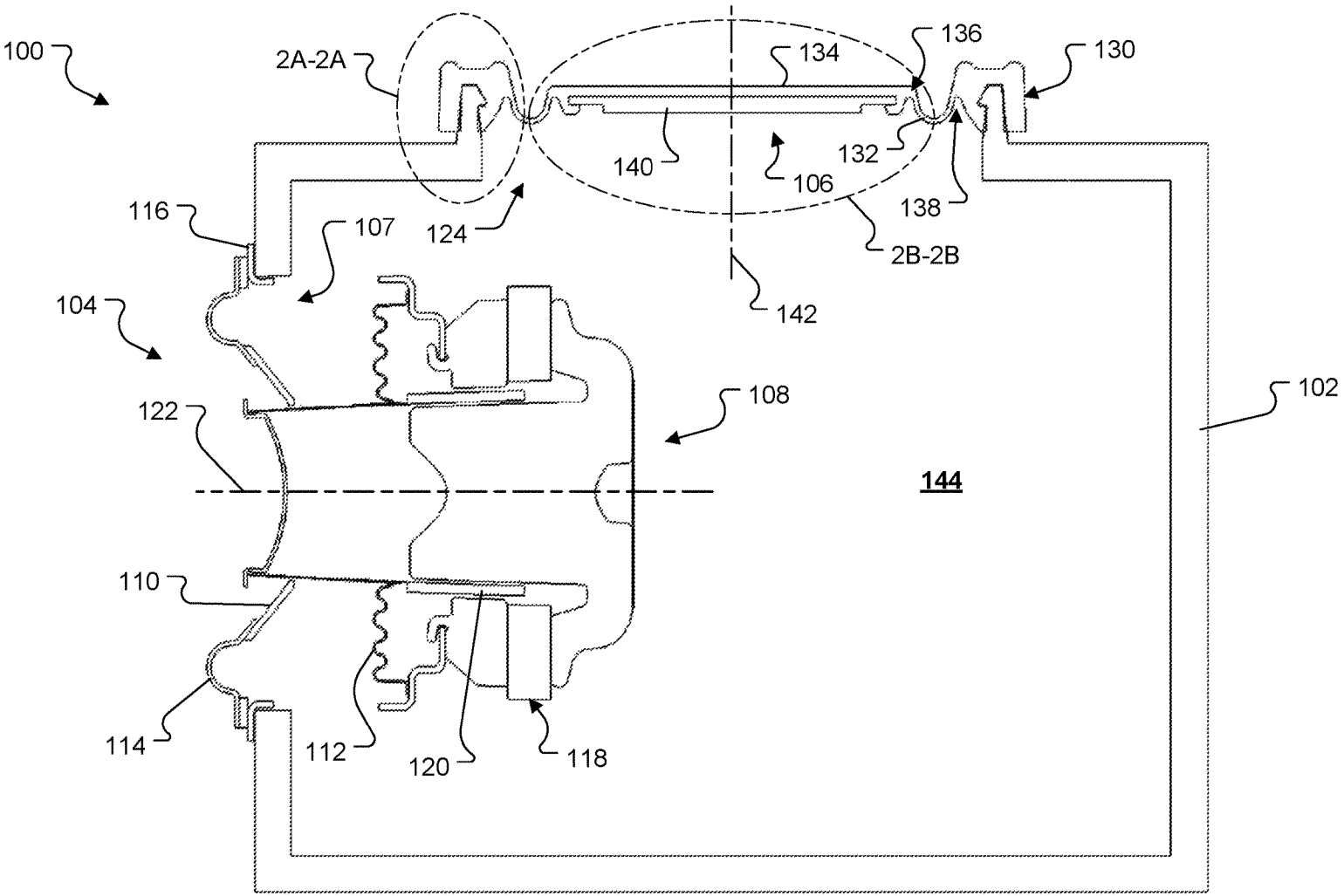
FIG. 1B is a cross-sectional side view of the loudspeaker of FIG. 1A.

Referring to FIG. 1B, the electro-acoustic transducer 104 is mounted within and acoustically seals a first opening 107 in the acoustic enclosure 102. The electro-acoustic transducer 104 includes an electric motor 108, a diaphragm 110, a suspension (112, 114), and a frame 116. The electric motor 108 includes a magnet assembly 118 and voice coil 120 through which an electrical audio signal flows. The flowing current of the audio signal alternates, creating an electromagnetic field which is opposed by a permanent magnetic field of the magnet assembly. This causes the voice coil 120 and diaphragm 110 to move in a pistonic motion along a motion axis 122 of the electro-acoustic transducer 104. This movement of the diaphragm 110 pumps air and creates sound waves.

The suspension includes a spider 112 and a surround 114. The suspension helps to center the voice coil 120 relative to the magnet assembly 118 and it exerts a restoring force to keep it so centered. The suspension 112 also helps to limit the maximum mechanical excursion of the diaphragm 110 and voice coil 120.

The frame 116 provides a rigid structure to which the other transducer components are mounted and it serves as the mounting structure for coupling the transducer 104 to the acoustic enclosure 102. In that regard, the frame 116 is secured to the acoustic enclosure 102 with mechanical fasteners (e.g., screws) such that the transducer 104 has an airtight seal with the acoustic enclosure 102. In some cases a gasket may be provided between the frame 116 and the acoustic enclosure 102 to help ensure that an air tight seal is formed. The frame 116 can be made of stamped steel, cast aluminum or plastic.

The passive radiator 106 is mounted within and acoustically seals a second opening 124 in the acoustic enclosure 102. The passive radiator 106 includes an elastomeric member 130 that defines a suspension structure 132 and a diaphragm 134. The diaphragm 134 is arranged along an inner peripheral boarder 136 of the suspension structure 132. The suspension structure 132 resiliently supports the diaphragm 134 so as to allow for relative movement between the diaphragm 134 and the acoustic enclosure 102. In the illustrated example, the suspension structure 132 is in the form of a half-roll surround with a concave outer surface and an opposite, convex inner surface.

In the illustrated example, the convex surface faces into the acoustic cavity 144. In that regard, it can be beneficial for the suspension structure 132 to be more firmly attached away from the mass-retention snap feature (i.e., the second snap-attach feature, discussed below), so as it stresses it does not pull the snap open. In addition, in a space constrained design it can be beneficial to have the thickness of the suspension structure 132 to be mainly centered and contained within the thickness of the mass+diaphragm stackup (so as not to add room required for travel). And lastly, it can be beneficial from a cosmetic perspective to have the mass on the inside (hidden from view). So with these three things in mind it sums up to wanting the concave surface of the roll on the outside and the convex side on the inside.

Notably, the elastomeric member 130 also defines a first snap-attach feature that is arranged along an outer peripheral boarder 138 of the suspension structure 132 for coupling the passive radiator 106 to a mating feature on the acoustic enclosure 102 and in such a manner as to form an air tight seal therebetween.

A mass 140 is coupled to the diaphragm 134 and configured for pistonic movement therewith, relative to the first snap-attach feature, along a motion axis 142 of the passive radiator 106. In the illustrated embodiment, the elastomeric member 130 further defines a second snap-attach feature which is arranged along the inner peripheral boarder 136 of the suspension structure 132 for coupling the mass 140 to the diaphragm 134. The elastomeric member 130 can be formed of a low durometer material, such as silicone rubber, and can be formed in a compression molding or injection molding process. The use of a low durometer material helps to ensure that the suspension structure has sufficient resilience to allow for movement of the diaphragm 134.

During operation of the loudspeaker 100, the transducer 104 acoustically energizes an acoustic cavity 144 defined by the acoustic enclosure 102, which causes the diaphragm 134 of the passive radiator 106 to vibrate and emit sound waves.

Figure 2A:
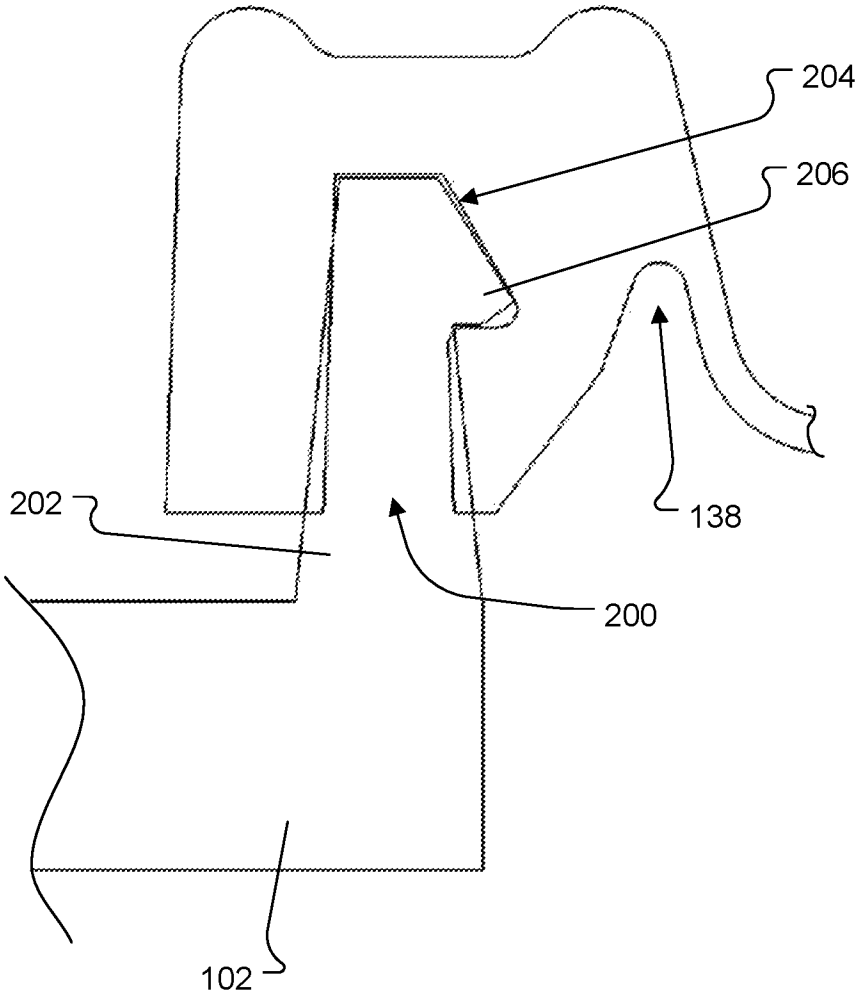
FIG. 2A is detailed view showing a portion of a passive radiator from detail 2A-2A of FIG. 1B.

Referring to FIG. 2A, the first snap-attach feature includes a recess 200 for receiving a rib 202 on the acoustic enclosure 102. The recess 200 defines a groove 204 for receiving a detent 206 on the rib 202. The recess 200 and the groove 204 may extend continuously in a closed form (e.g., in a closed ring, square, or rectangle) about the outer peripheral boarder 138 of the suspension structure 132. Likewise, the rib 202 and the detent 206 may extend continuously in a closed form that corresponds generally to that of the recess 200 and groove 204.

The groove 204 extends along an inner peripheral edge of the recess 200 such that the groove 204 faces inward toward the motion axis 142 (FIG. 1B) of the passive radiator 106. There will be pressure trying to move the inner elastomeric surfaces relative to the enclosure 102. The outside lip of material, however will not see this pressure since it is not exposed to the internal box pressure. To keep the elastomeric member 130 held firmly in place for consistent performance and low noise, the interface between the groove 204 and detent 206 should be on the inside surface so that it is retained to the enclosure walls as close as possible to where the forces are exerted upon it.

The recess 200 may be undersized relative to the rib 202 and/or the groove 204 may be undersized relative to the detent 206 to form a compression fit therebetween. A compression fit help to ensure that an air tight seal is provided at the junction between the passive radiator 106 and the acoustic enclosure 102. The first snap-attach feature (i.e., the recess 200 and groove 204) being formed from a compliant material will deform to accommodate the mating feature (i.e., the rib and detent) on the acoustic enclosure 102 which is formed a rigid material, such as metal or plastic.

The snap-attach feature provides a sufficiently strong coupling to keep the outer peripheral boarder 138 of the suspension structure 132 connected to the acoustic enclosure 102 during use (i.e., during excursion of the diaphragm 134). The snap-attach feature provides simple and quick way to attach the passive radiator to the enclosure, which can reduce the total number of parts needed by reducing the need for fasteners or adhesive, and can reduce assembly time associated with installing fasteners and/or adhesive. The snap-attach feature can also allow for quick and nondestructive removal of the passive radiator 106, e.g., to allow for servicing of the loudspeaker 100 (FIG. 1A).

Figure 2B:
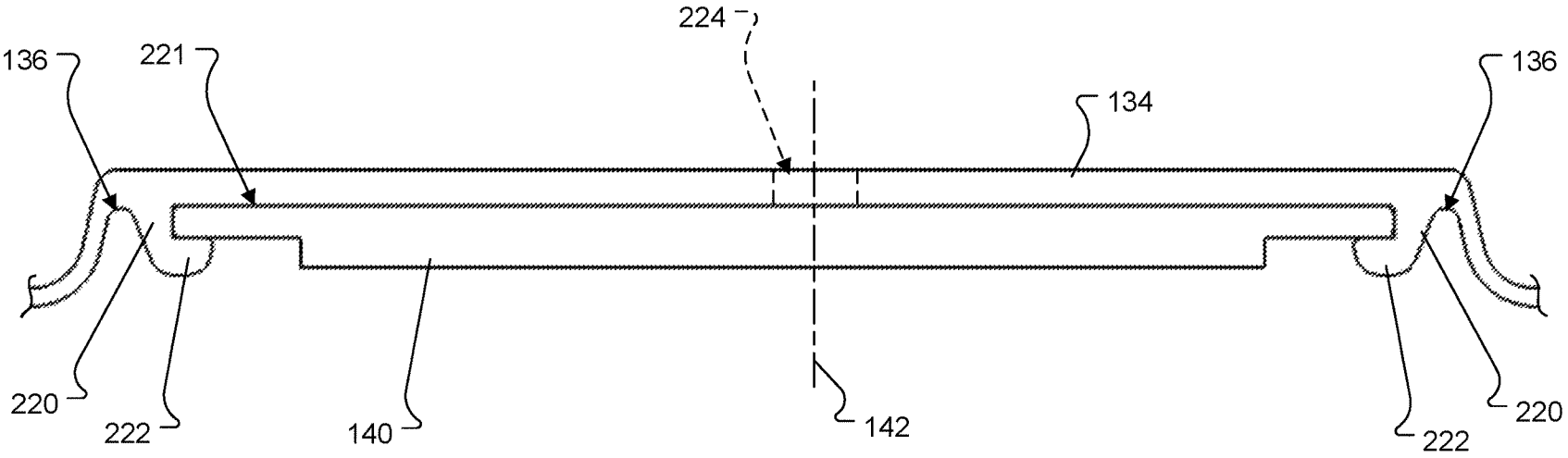
FIG. 2B is a detailed view of the passive radiator from detail 2B-2B of FIG. 1B.

With reference to FIG. 2B, the second snap-attach feature includes a sidewall 220 that extends outwardly from the diaphragm 134 and forms a pocket 221 therewith for receiving the mass 140. The sidewall 220 includes a protrusion 222 for engaging an area along the peripheral edge of the mass 140 thereby to retain the mass 140 in the pocket 221.

In the illustrated embodiment, the outer surface of the sidewall 220 is angled so that the thickness of the sidewall is maximized near its base, where the maximum interference with the mass 140 is. It is beneficial if the coupling between the second snap-attach feature and the mass 140 is close to an interference fit to prevent buzzing during movement of the diaphragm 134. The second snap-attach feature (i.e., the sidewall 220 and the protrusion 222) being formed from a compliant material will deform to accommodate the rigid mass 140.

The sidewall 220 and the protrusion 222 may extend continuously in a closed form (e.g., in a closed ring, square, or rectangle) about the inner peripheral boarder 136 of the suspension structure 132. The protrusion 222 extends inward, from the sidewall 220, toward the motion axis 142 of the passive radiator 106. The pocket 221 is arranged to face into the acoustic enclosure when mounted thereto. The snap-attach feature being on the inside (i.e., facing into the acoustic cavity) can be beneficial because the forces that drive the diaphragm 134 are exerted on that side, which can help to keep the mass coupled to the diaphragm 134 by applying a force that effectively pushes the mass into the pocket 221.

The second snap-attach feature provides a simple attachment mechanism that allows removal and replacement of the mass 140, thus enabling the tuning of the passive radiator 106 to be adjusted both and/or after assembly. Such tuning adjustment is generally not possible with prior art devices that rely on insert molding or adhesive for coupling a mass to a diaphragm. Being able to remove and/or replace the mass not only allows tuning for particular production runs of a single device, but can also enable a shift in loudspeaker design towards a more uniform passive radiator design that could potentially be used with many devices and just adjusted by using different masses.

In some cases, once an appropriate mass is selected to provide the desired tuning, the mass can then be adhered in the pocket. This allows for the flexibility of selectively applying different masses to achieve the desired tuning, while also providing an enhanced coupling between the mass and the diaphragm once the mass is selected.

In some cases, the elastomeric member may further define one or more through holes 224 that extends through the diaphragm to allow air that might get trapped between the mass 140 and the diaphragm 134 to be released as the mass 140 is inserted into the pocket 221.

While implementations have been described in which the recess and the groove of the first snap-attach feature extend continuously about the outer peripheral boarder of the suspension structure, in some implementations, the first snap-attach feature may instead include a plurality of discrete recesses, each defining an associated groove, which are spaced in an array about the outer peripheral boarder of the suspension structure. Similarly, the mating feature on the acoustic enclosure may include a plurality of ribs, each with an associated detent, which may be arranged in a corresponding array that coincides with the recesses and grooves on the passive radiator.

Alternatively, the first snap-attach feature may include a recess that extends continuously in a closed form about the outer peripheral boarder of the suspension structure. The recess can define a plurality of discrete grooves that are spaced apart in an array (e.g., a radial array). Likewise, the rib on the acoustic enclosure may extend continuously in a closed form that corresponds generally to that of the recess, and it may define a plurality of discrete detents arranged in an array to coincide with the grooves. So, rather than providing one continuous snap location, a plurality of discrete snap locations are formed.

Although implementations have been described in which the sidewall and the protrusion extend continuously in a closed form about the inner peripheral boarder of the suspension structure, in other implementations, the second snap-attach feature may include a plurality of discrete sidewalls that each define a corresponding protrusion, and which are arranged in a spaced array to define, together with the diaphragm, a pocket for receiving the mass.

Alternatively, the sidewall may extend continuously in a closed form (e.g., in a closed a ring) about the inner peripheral boarder of the suspension structure, and it may define a plurality of discrete protrusions that are arranged in a spaced array for engaging an area along the peripheral edge of the mass thereby to couple the mass to the diaphragm.

In some cases, these snap-attach features can be used in conjunction with an adhesive for coupling the components in ways that might not be achievable or sufficient with adhesive alone. This combination of attachment mechanisms can provide for a more robust coupling than the snap-attach feature provides alone, while, at the same time, the presence of the snap-attach feature may allow a less strong adhesive, or a reduced amount of adhesive, to be used so that the parts can still be separated without damaging them.

A number of implementations have been described. Nevertheless, it will be understood that additional modifications may be made without departing from the scope of the inventive concepts described herein, and, accordingly, other implementations are within the scope of the following claims.

What is claimed is:

1. A passive radiator comprising:

an elastomeric member which defines:

a suspension structure having an inner peripheral boarder and an outer peripheral boarder;

a first snap-attach feature arranged along the outer peripheral boarder of the suspension structure for coupling the elastomeric member to a mating feature; and a mass supported along the inner peripheral boarder of the suspension structure and configured for pistonic movement, relative to the first snap-attach feature, along a motion axis of the passive radiator.

2. The passive radiator of claim 1, wherein the first snap-attach feature comprises a recess for receiving a rib of the mating feature, wherein the recess defines a groove for receiving a detent on the rib.

3. The passive radiator of claim 2, wherein the groove faces inward toward the motion axis of the passive radiator.

4. The passive radiator of claim 1, wherein the first snap-attach feature comprises a recess that extends continuously in a closed form about a periphery of the suspension structure for receiving a peripheral rib of the mating feature, wherein the recess defines a groove for receiving a detent on the peripheral rib.

5. The passive radiator of claim 4, wherein the groove extends along an inner peripheral edge of the recess.

6. The passive radiator of claim 1, wherein the suspension structure is in the form of a half-roll surround.

7. The passive radiator of claim 1, wherein the elastomeric member further defines a second snap-attach feature for coupling the mass to the elastomeric member.

8. The passive radiator of claim 7, wherein the elastomeric member further defines a diaphragm and wherein the second snap-attach feature comprises a sidewall that extends outwardly from the diaphragm and forms a pocket therewith for receiving the mass, wherein the sidewall includes a protrusion for engaging an area along the peripheral edge of the mass thereby to retain the mass in the pocket.

9. The passive radiator of claim 8, wherein the protrusion extends inward toward the motion axis of the passive radiator.

10. The passive radiator of claim 8, wherein the elastomeric member further defines a through hole that extends through the diaphragm to allow air trapped between the mass and the diaphragm to be released as the mass is inserted into the pocket.

11. A passive radiator comprising:

a mass; and an elastomeric member which defines:

a suspension structure having an inner peripheral boarder and an outer peripheral boarder; and a first snap-attach feature along the inner peripheral boarder of the suspension structure for coupling the elastomeric member to the mass.

12. The passive radiator of claim 11, wherein the elastomeric member further defines a diaphragm and wherein the first snap-attach feature comprises a sidewall that extends outwardly from the diaphragm and forms a pocket therewith for receiving the mass, wherein the sidewall includes a protrusion for engaging an area along the peripheral edge of the mass thereby to retain the mass in the pocket.

13. The passive radiator of claim 12, wherein the protrusion extends inward toward a motion axis of the passive radiator.

14. The passive radiator of claim 12, wherein the elastomeric member further defines a through hole that extends through the diaphragm to allow air trapped between the mass and the diaphragm to be released as the mass is inserted into the pocket.

15. The passive radiator of claim 11, wherein the elastomeric member further defines a second snap-attach feature arranged along the outer peripheral boarder of the suspension structure for coupling the elastomeric member to a mating feature, the second snap-attach feature comprising:

a recess that extends continuously in a closed form about a periphery of the suspension structure for receiving a rib of the mating feature, wherein the recess defines a groove for receiving a detent on the peripheral rib.

16. The passive radiator of claim 15, wherein the groove faces inward toward the motion axis of the passive radiator.

* * * * *